United States Patent [19]

Curtil

[11] 3,968,643

[45] July 13, 1976

[54] WRISTWATCH CASE AND WRISTLET ASSEMBLY

[76] Inventor: Marcel Curtil, 10, rue Marie-Louise, 25000 Besancon, France

[22] Filed: Mar. 25, 1975

[21] Appl. No.: 561,907

[30] Foreign Application Priority Data

Mar. 28, 1974 Switzerland ..... 4348/74

[52] U.S. Cl. ..... 58/88 R; 224/4 D; 224/4 E

[51] Int. Cl.[2] ..... G04B 37/00; A45C 11/10

[58] Field of Search ..... 58/88 R, 88 E, 88 G, 58/90 B; 224/4 A, 4 B, 4 D–4 K, 28 R, 28 W

[56] References Cited

UNITED STATES PATENTS

| | | | |
|---|---|---|---|
| 2,189,096 | 2/1940 | Alonge | 224/4 F |
| 2,219,277 | 10/1940 | Kaufmann | 58/88 R |
| 2,472,351 | 6/1949 | Tyler | 58/88 R |
| 2,532,161 | 11/1950 | Gomberg | 224/4 K |
| 2,602,573 | 7/1952 | Herbst | 224/4 K |
| 3,019,503 | 2/1962 | Placco et al. | 224/4 E X |
| 3,492,809 | 2/1970 | Gisiger-Lusa | 58/88 R |
| D139,596 | 12/1944 | Preas | 224/4 K |
| D143,816 | 2/1946 | Flatau | 224/4 K |

*Primary Examiner*—Ulysses Weldon
*Attorney, Agent, or Firm*—Robert E. Burns; Emmanuel J. Lobato; Bruce L. Adams

[57] ABSTRACT

A molded plastic wristwatch case has a rear face with a flat peripheral shoulder and a protruding back having horns, which fits on a complementary central case-receiving part of a plastic wristlet also molded in a single piece. Lateral extremities of shoulders on the wristlet fit around and conceal the case horns.

6 Claims, 9 Drawing Figures

FIG. 1
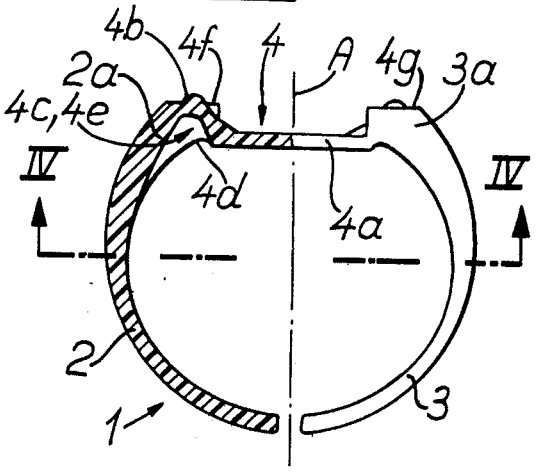
FIG. 2
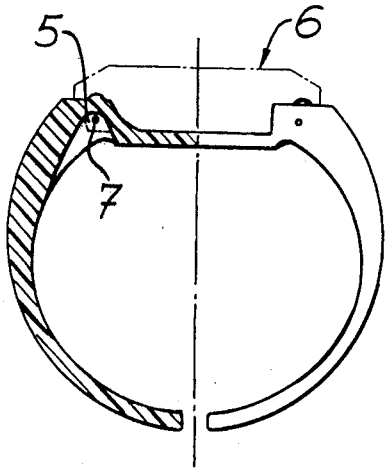
FIG. 3
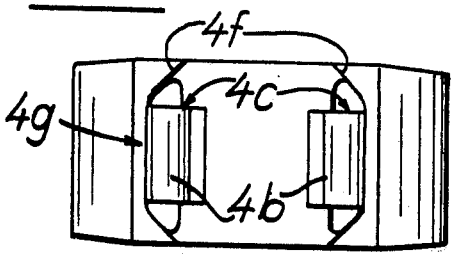
FIG. 4
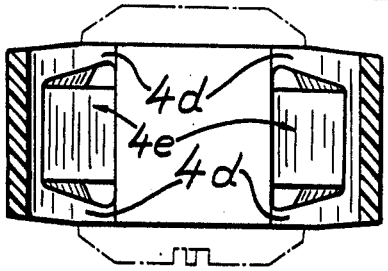
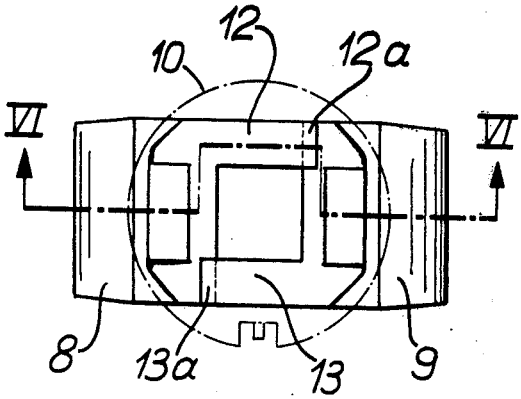
FIG. 5
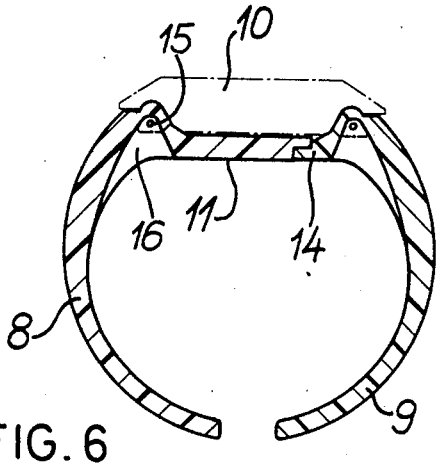
FIG. 6

WRISTWATCH CASE AND WRISTLET ASSEMBLY

BACKGROUND OF THE INVENTION

The invention relates to wristwatches.

A conventional method of securing a wristlet to a watch case is to provide the case with lugs or horns joined by a spring-loaded bar. U.S. Pat. No. 1,806,439 (Barton) discloses a C-band of spring metal having loops formed therein for cooperation with such bars. In this construction, the spring band simply replaces the classic strap or bracelet sections, and the horns remain visible.

Japanese Utility model No. 1,018,350 (Citizen Watch Co. Ltd.) proposes a single-piece wristlet of plastic material or rubber having a thick central part with a recess in which the watch case is embedded, the conventional securing horns and bars thus being dispensed with. However, using this system, each model of watch case must have a special wristlet.

An object of the invention is to provide a wristwatch in which a case is mounted on a wristlet in a manner to enable easy interchange, by providing the rear part of each watch case and a case-receiving part of the wristlet with a complementary shape.

Another object of the invention is to employ the conventional and well-tested horn and bar securing system while concealing the horns from view whereby the watchcase and bracelet may have a pleasing aesthetic appearance.

SUMMARY OF THE INVENTION

In a watchcase according to the invention, a rear face of the case includes a rearwardly facing generally flat peripheral first shoulder and a back protruding rearwardly from the peripheral first shoulder. The back has two pairs of wristlet-securing horns extending from opposite sides of the back and disposed within the bounds of the peripheral first shoulder, each pair of horns having outer faces and facing inner faces. The front face of a case-receiving central part of the wristlet has a complementary shape to the rear face of the bracelet. It includes: two spaced-apart second shoulders each of which bears against a part of said first shoulder of the case and each including a pair of lateral extremities shaped to fit about the outer faces of a pair of horns of the case; a middle portion inset from said second shoulders complementary to at least a part of the rear surface of said back of the case; and two bulges joining said second shoulders to said inset middle portion, each bulge extending from between the extremities of the respective second shoulder and being shaped to fit between a pair of horns of the case. The rear face of the central part of the wristlet has a recess under each of said bulges and lateral openings through said bulges facing said extremities of said second shoulders. A pair of wristlet securing bars, preferably of the spring-loaded type, are disposed in said recesses, end parts of these bars removably securing the horns of the case between said extremities.

The wristlet is preferably molded in a single piece of semi-rigid synthetic plastic material, said central case-receiving part being extended by two tapering resilient curved arms.

The front face of the case preferably includes an integral bezel, the case being molded in a single piece of synthetic plastic material.

Hence, the front face of the case-receiving central part of the wristlet may be molded with substantially the same shape as part of the mold for forming the rear face of the case. The cases are preferably molded as disclosed in my copending application Ser. No. 499,191, using a single first mold to define a common rear face for several series of cases, and several second molds for providing front faces of different shapes.

BRIEF DESCRIPTION OF THE DRAWINGS

Embodiments of the invention will now be specifically described, by way of example, with reference to the accompanying drawings, in which:

FIG. 1 is an axial cross-section and side elevation of a first form of wristlet;

FIG. 2 is a similar view of a modified form of wristlet, with a watch-case shown in a dot-dash line;

FIG. 3 is a top plan view of the wristlet of FIG. 1;

FIG. 4 is a cross-section taken along line IV—IV of FIG. 1;

FIG. 5 is top plan view of a further form of wristlet, with a watch case shown in a dot-dash line;

FIG. 6 is a cross-section taken along line VI—VI of FIG. 5;

DESCRIPTION OF THE PREFERRED EMBODIMENTS

Figure 7:
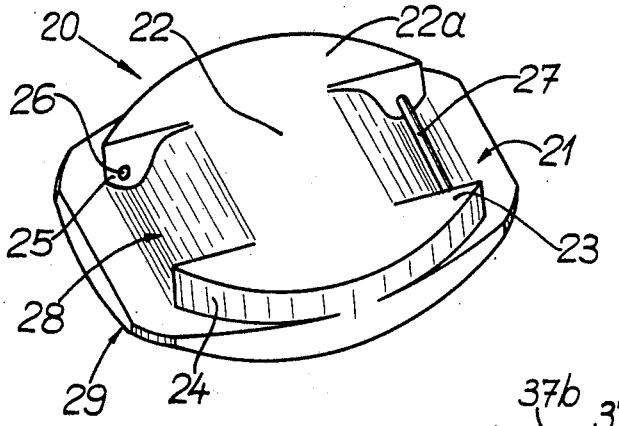
FIG. 7 is a rear perspective view of a watch case with a fitted wristlet-securing bar.

The wristlet 1 shown in FIGS. 1, 3 and 4, molded from a single piece of resilient plastic material, comprises two like incurved arms 2 and 3 extending from a central case-receiving part 4, the bracelet being symmetrical about a central plane A. The arms 2, 3 have thick ends 2*a*, 3*a* adjacent part 4, and taper to narrow free ends. The material is sufficiently flexible to allow separation of the free ends of the arms for fitting the wristlet on a wrist, and removing it.

The central part 4 has a flat middle part or bottom 4*a* inset between flat shoulders 4*g* adjacent ends 2*a*, 3*a*. Shoulders 4*g* have lateral extremities 4*f* with inner faces at approximately 45° (FIG. 3) and are joined by central bulges 4*b* to the bottom 4*a*. The rear face of part 4 (FIG. 4) has recesses 4*e* under bulges 4*b*, and the bottom 4*a* is joined to arms 2, 3 by lateral bridges 4*d*. Openings 4*c* open through the bottom 4*a* and through the lateral faces of bulges 4*b*/recesses 4*e* facing the extremities 4*f*.

FIG. 2 shows a modified form of bracelet including holes 7 in the extremities (as 4*f* of FIG. 1) for receiving the ends of bars passing through horns 5 of a watch case 6. With the bracelet of FIG. 1, bars for securing the wristlet to a watch case fit in holes in the horns of the case, as will be described later.

FIGS. 5 and 6 show another form of wristlet formed of two discrete like arms 8, 9 which can be interconnected to form a flat bottom 11 to receive the back of a case 10. In addition to a shoulder and a bulge, as before, each arm 8, 9 has a section of a middle portion, including a projection 12, 13 with a stepped end 12*a*, 13*a* interfitting in a complementary step in the opposite arm, 9 or 8 respectively. The wristlet arms are held securely together, and to case 10, by placing bars 15 in recesses 16 in the underside of the wristlet, ends of these bars engaging in horns of case 10, as will be described later.

FIG. 7 shows a case 20 with a rear face delimited by a flat rearwardly-facing generally oval peripheral shoulder 21 and having a back 22 protruding centrally from shoulder 21. Back 22 includes two pairs of horns 23 each having a curved outer face 24. The pairs of horns 24 have facing flat inner faces 25 with holes 26 for receiving the ends of a spring-loaded wristlet-securing bar 27. Between each pair of horns 23 is a recess 28 inset below shoulder 21 and extending up to a flat central part of back 22. Lateral parts 22*a* of back 22, corresponding to the horns 23, are slightly inclined to the flat central part.

The case 20 also has a front face 29 including an integral bezel 30 supporting a glass 31. The case, including bezel 30, is molded in a single piece of plastic material, and houses a conventional movement and time display, not shown.

Figure 8:
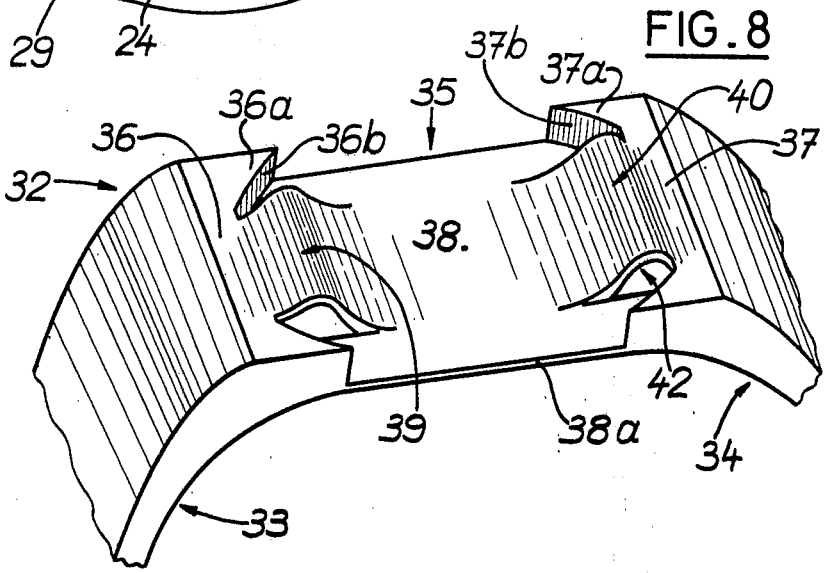
FIG. 8 is a perspective view of the central part of another form of wristlet.
Figure 9:
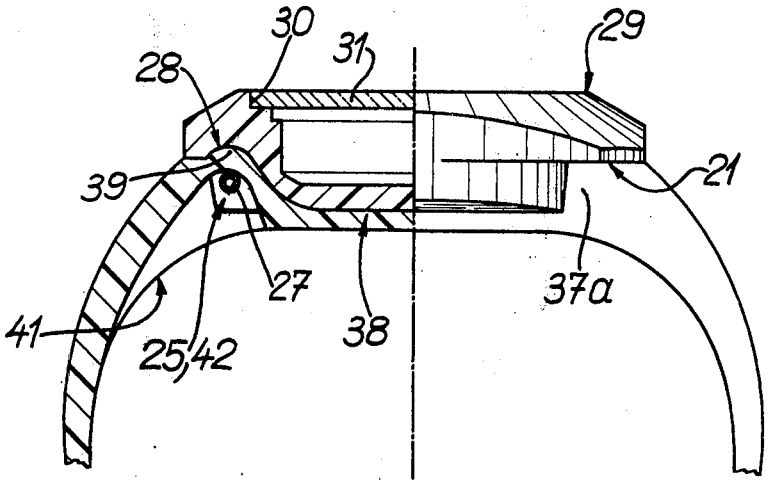
FIG. 9 is an axial cross-section and side elevation of the case of FIG. 7 secured on the wristlet of FIG. 8.

Case 20 is mounted on a wristlet 32 as shown in FIG. 9. Wristlet 32, molded from a single piece of plastic material, FIG. 8, has two like curved resilient arms 33, 34 tapering from a central case-receiving part 35 the front face of which is limited by flat spaced-apart shoulders 36, 37. These shoulders have lateral extremities 36*a*, 37*a* having curved inner faces 36*b*, 37*b* complementary to the outer faces 24 of horns 23. Inset between shoulders 36, 37 is a flat middle portion 38 of part 35 having slightly upwardly inclined edges 38*a*. The central parts of shoulders 36, 37 between the pairs of extremities 36*a*, 37*a* are joined to the middle portion 38 by bulges 39, 40 respectively, each bulge being shaped to fit exactly in a recess 28 of case 20. In the rear face of part 35, under bulges 39, 40 are recesses 41 having lateral openings 42 through the bulges facing the curved faces 36*b* or 37*b* of extremities 36, 37. These recesses 41 are accessible from the rear of the wristlet, for the insertion of bars 27 whose ends pass through openings 42 and engage in holes 26 to firmly hold the horns 23 of case 20 which are placed between the complementary extremities 36*a*, 37*a*.

When the case 20 is thus fitted, FIG. 9, a part of back 22 bears against portion 38 of the wristlet. The inclined lateral parts 22*a* of the back rest on edges 38*a* from which they protrude laterally. As shown in the right hand part of FIG. 9, the extremities 37*a* (and 36*a*) envelop part of the curved outer faces 24 of horns 23, and thus conceal the horns. Each bar 27 rests against the bottom of a recess 28.

Although the back 22 of case 20 is shown disposed centrally of the peripheral shoulder 21, it is possible to dispose this back eccentrically to provide a case with an assymetric front face 29. Also the shoulder 21 and hence the front face 29 of the case may be of various shapes, such as circular, as case 10 (FIG. 5). Also the long axis of an oval or generally rectangular case could be disposed parallel to bars 27, instead of perpendicular thereto as shown in FIG. 7. The peripheral shoulder 21 of the case may extend continuously around the entire periphery, or may also be in two parts as shown in FIG. 7.

When, as preferred, series of case 20 are molded all with an identical rear face of complementary shape to part 35, and with front faces 29 of different shape, as set out in my copending application Ser. No. 499,191, there is considerable scope for interchanging cases of different shapes on wristlets for example of different colors, whereby the wearer can readily adapt the wristwatch to match different ensembles or make-up.

The form of recesses (4*e* or 41), which taper along the length of the arms of the wristlet, facilitates insertion of the bars while allowing ready access from the rear of the wristlet for removal, for example by means of a knife blade.

What is claimed is:

1. A wristwatch comprising a case having a front face and a rear face;

said rear face of the case including a rearwardly-facing generally flat peripheral first shoulder and a back protruding rearwardly from said peripheral first shoulder, said back having two pairs of wristlet-securing horns extending from opposite sides of said back and disposed within the bounds of said peripheral first shoulder, each pair of horns having outer faces and facing inner faces;

a wristlet including a central case-receiving part having a front face and a rear face;

said front face of the central part of the wristlet having a complementary shape to said rear face of the case and including two spaced-apart second shoulders each adapted to bear against a part of said first shoulder of the case and each including a pair of lateral extremities shaped to fit about the outer faces of said pair of horns of the case, a middle portion inset from said second shoulders complementary to at least a part of the rear surface of said back of the case, and two bulges joining said second shoulders to said inset middle portion, each bulge extending from between the extremities of the respective second shoulder and being shaped to fit between a pair of horns of the case;

said rear face of the central part of the wristlet having recesses defined by said bulges and lateral openings through said bulges facing said extremities of said second shoulders for receiving wristlet-securing bars;

and wristlet-securing bars disposed in said recesses and having end parts removably securing the horns of the case between said extremities.

2. A wristwatch according to claim 1, in which the wristlet is molded in a single piece of semi-rigid synthetic plastic material, said central case-receiving part being extended by two tapering resilient curved arms.

3. A wristwatch according to claim 1, in which said front face of the case includes an integral bezel, the case being molded in a single piece of synthetic plastic material.

4. A wristwatch according to claim 1, in which said rear face of the case has recesses inset from said first shoulder and disposed between said pairs of horns, said recesses being of complementary shape to said bulges of the wristlet.

5. A wristwatch according to claim 1, in which said rear face of the case is disposed centrally of said peripheral first shoulder.

6. A wristwatch according to claim 1, in which the wristlet is formed of two discrete identical arms each including a first shoulder, a bulge, and a section of the middle portion, said sections of the middle portion being interengageable with one another and being secured together and to the watch case by said bars.

* * * * *